US006517319B2

(12) United States Patent
Webster et al.

(10) Patent No.: US 6,517,319 B2
(45) Date of Patent: Feb. 11, 2003

(54) GAS TURBINE ENGINE ROTOR BLADES

(75) Inventors: John R Webster, Derby (GB); Toby J Miles, Sutton Coldfield (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/953,854

(22) Filed: Sep. 18, 2001

(65) Prior Publication Data

US 2002/0037219 A1 Mar. 28, 2002

(30) Foreign Application Priority Data

Sep. 22, 2000 (GB) ..... 0023293

(51) Int. Cl.[7] ..... F03B 3/12
(52) U.S. Cl. ..... 416/241
(58) Field of Search ..... 416/223 R, 241 R, 416/223 A; 72/76, 710

(56) References Cited

U.S. PATENT DOCUMENTS

| | | | | |
|---|---|---|---|---|
| 4,428,213 A | * | 1/1984 | Neal et al. | 72/53 |
| 5,591,009 A | * | 1/1997 | Mannava et al. | 416/241 R |
| 6,338,765 B1 | * | 1/2002 | Statnikov | 148/558 |
| 6,343,495 B1 | * | 2/2002 | Cheepe et al. | 72/53 |

FOREIGN PATENT DOCUMENTS

| | | |
|---|---|---|
| EP | 1065289 A | 1/2001 |
| SU | 245827 A | 6/1969 |
| SU | 1447888 A | 12/1988 |

* cited by examiner

*Primary Examiner*—Edward K. Look
*Assistant Examiner*—Dwayne J. White
(74) *Attorney, Agent, or Firm*—W. Warren Taltavull; Manelli Denison & Selter PLLC

(57) ABSTRACT

A component for a gas turbine engine having at least one surface, that has been treated by ultrasonic hammer peening so as to provide a region of deep compressive residual stress in the treated region.

10 Claims, 2 Drawing Sheets

GAS TURBINE ENGINE ROTOR BLADES

FIELD OF THE INVENTION

This invention relates to components for gas turbine engines. More particularly this invention is concerned with the surface treatment of gas turbine engine components and a method for producing such blades.

BACKGROUND OF THE INVENTION

Gas turbine engine components and in particular aerofoil blades and vanes are susceptible to damage caused by foreign object ingestion and general fatigue. Such damage may result in stress concentrations and cracks which limit the aerofoils life. One known solution is to increase the thickness of the aerofoil in the leading and trailing edges which are most susceptible to damage. However this adds weight and adversely affects the erodynamic performance of the aerofoil and reduces the efficiency of the engine.

It has also previously been proposed to introduce regions of residual compressive stress into the aerofoil and ideally through section compression to reduce the tendency of crack growth. By creating such 'through thickness compression' whereby the residual stresses in the edges of the aerofoil are purely compressive, the tendency for cracks to grow is severely reduced. The stress field is equalised out in the less critical remainder of the aerofoil.

Prior U.S. Pat. Nos. 5,591,009 and 5,531,570 disclose a fan blade with regions of deep compressive residual stresses imparted by laser shock peening at the leading and trailing edges of the fan blade. The method for producing this fan blade includes the use of multiple radiation pulses from high power pulsed lasers producing shock waves on the surface of the fan blade. However the processes disclosed in these prior patents have a number of disadvantages. The magnitude of stress that can be induced is limited and the penetration of depth of these stresses is also limited while the process is generally time consuming and costly. Laser shock peening can typically provide a penetration depth of 1 mm.

SUMMARY OF THE INVENTION

It is an aim of the present invention, therefore, to provide an improved gas turbine engine component which is longer lasting and better able to withstand fatigue and/or foreign object damage.

According to the present invention there is provided a component one or more surfaces wherein at least one of said surfaces comprises an ultrasonic hammer peened surface and wherein a region of deep compressive residual stress caused by ultrasonic hammer peening is provided in said treated surface.

Also according to the present invention there is provided method of ultrasonic hammer peening a component comprising the step of ultrasonic hammer peeing at least one surface of said component so as to provide a region of deep residual compressive stress.

Also according to the present invention there is provided a method of ultrasonic hammer peening a gas turbine aerofoil blade or vane comprising the step of ultrasonic hammer peening at least one of the leading and trailing edges of said blade or vane on at least one of the suction and pressure sides thereof.

BRIEF DESCRIPTION OF THE DRAWINGS

The invention will now be described with reference to the accompanying drawings in which.

DETAILED DESCRIPTION OF THE INVENTION

Figure 1:
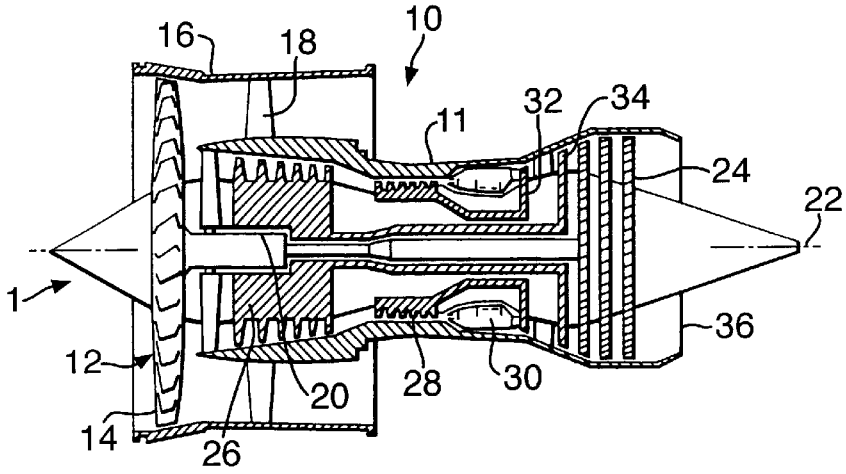
FIG. 1 is a schematic sectioned side view of a ducted fan gas turbine engine incorporating components in accordance with the present invention.

With reference to FIG. 1 a ducted fan gas turbine engine generally indicated at 10 is of mainly conventional construction. It comprises a core engine 11 which functions in the conventional manner to drive a propulsive fan 12 mounted at the upstream end of the core engine 11 (the term upstream as used herein is with respect to the general direction of gas flow through the engine 10, that is, from left to right as viewed in FIG. 1). The propulsive fan 12 comprises an annular array of radially extending aerofoil blades 14 and is positioned within a fan casing 16 which is supported from the core engine 11 by an annular array of generally radially extending outlet guide vanes 18. The ducted fan gas turbine engine 10 has a longitudinal axis 22 about which its major rotational parts rotate.

The fan 12 is mounted on a first shaft 20 which under normal load circumstances is coaxial with the engine longitudinal axis 22 and which is driven in the conventional manner by the low pressure turbine 24 of the core engine 11.

The first shaft 20 extends almost the whole length of the ducted fan gas turbine engine 10 to interconnect the fan 12 and the low pressure turbine 24 of the core engine 11. The first shaft 20 is supported from the remainder of the core engine 11 by a number of bearings.

The gas turbine engine works in the conventional manner so that air entering the intake 11 is accelerated by the fan 12 to produce two air flows, a first air flow into the intermediate pressure compressor 26 and a second airflow which provides propulsive thrust. The intermediate pressure compressor 26 compressors the airflow directed into it before delivering the air to the high pressure compressor 28 where further compression takes place.

The compressed air exhausted from the high pressure compressor 28 is directed into the combustion equipment 30 where it is mixed with fuel and the mixture combusted. The resultant hot combustion products then expand through and thereby drive the high 32, intermediate 34 and low 24 pressure turbines before being exhausted through the nozzle 36 to provide additional propulsive thrust. The high 32, intermediate 34 and low 24 pressure turbines respectively drive the high 28 and intermediate 26 pressure compressors and the fan 12 by suitable interconnecting shafts.

Figure 2:
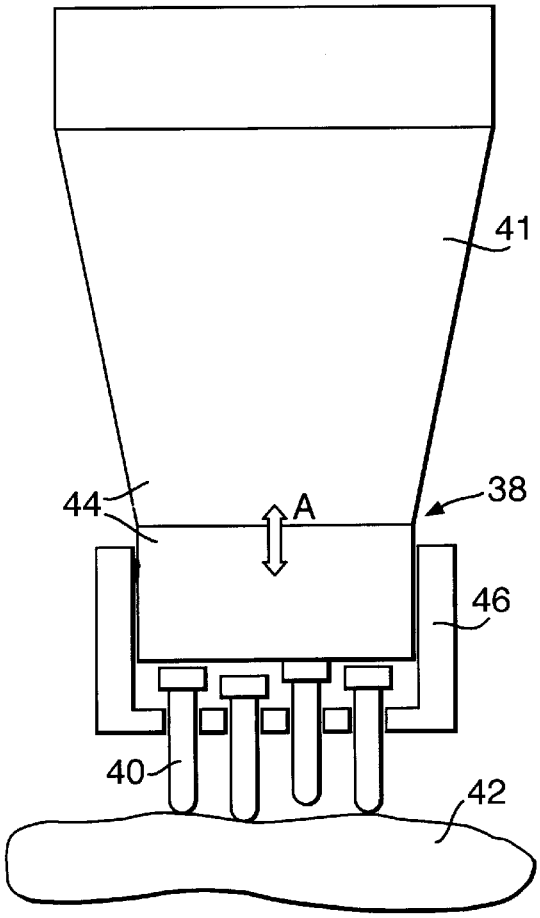
FIG. 2 is a schematic view of the basic apparatus for ultrasonic peening treatment according to the present invention.

FIG. 2 shows the basic apparatus used in the ultrasonic hammer peening treatment of a compressor blade for use in the gas turbine engine shown in FIG. 1. A hammer tool shown generally at 38 uses ultrasound to propel a number of miniature hammers or pins 40 onto the surface area 42 to be treated resulting in multiple impacts. The repeated movement of the hammers or pins 40 is indicated by arrow A. A magnetorestrictive transducer 41 is connected to a waveguide system 44 and a cartridge 46 supporting the striking pins or miniature hammers 40. The pins 40 are pressed against the surface 42 to be treated and the whole apparatus 38 is moved around the surface until the desired area has been treated whilst the magnetorestrictive transducer 41 is activator.

Figure 3:
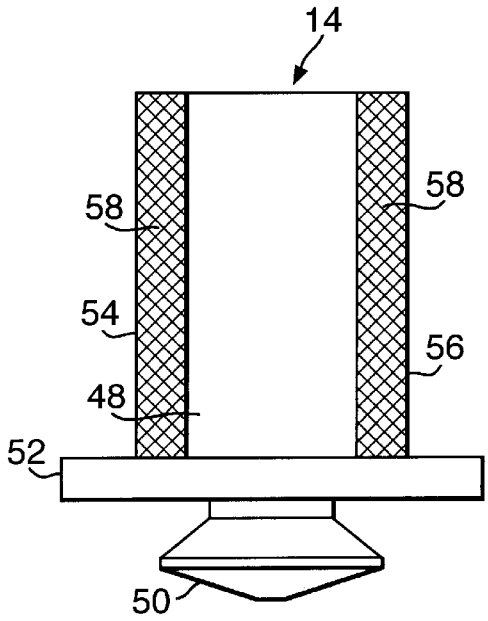
FIG. 3 is a schematic view of a gas turbine fan blade indicating areas of treatment according to the present invention.

Now referring to FIG. 3 a fan blade 14 comprises an aerofoil 48, a root portion 50 and a platform 52 connecting the root 50 of the blade 14 to the aerofoil 48. The aerofoil comprises a leading edge 54 and a trailing edge 56. The leading edge 54 and trailing edge 56 are subjected to ultrasonic hammer peening in accordance with the invention and this area is indication by shaded portions 58

Figure 4:
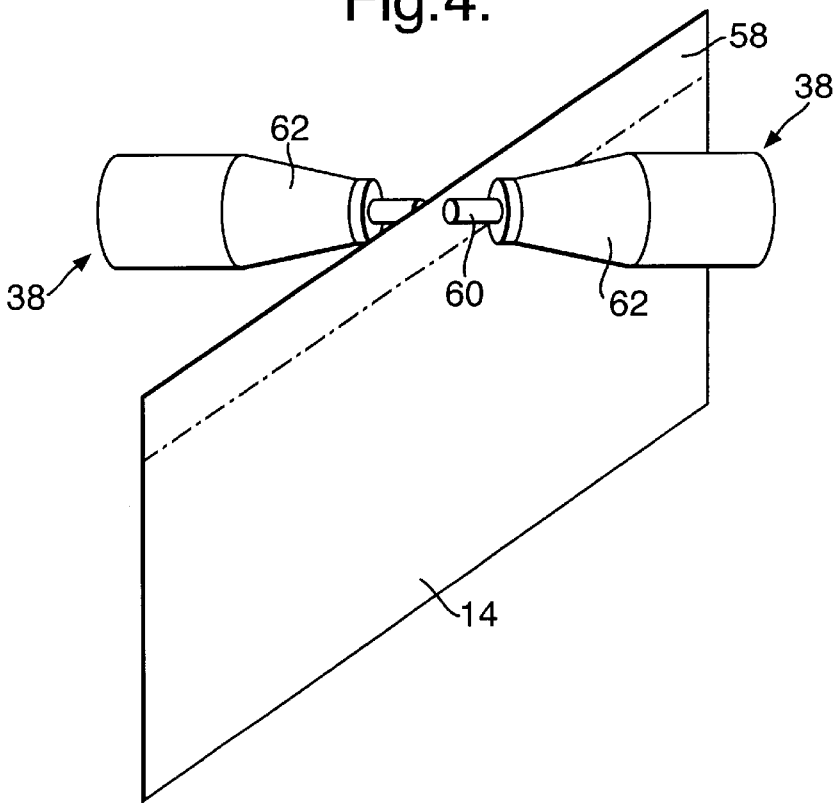
FIG. 4 is a schematic view of a gas turbine fan blade undergoing peening treatment according to the present invention.

These portions 58 of the aerofoil 48 are treated using ultrasonic hammer tool equipment 38 shown in FIG. 4. As with all surface treatment methods of this type the primary aim is to induce compressive residual stresses to improve the fatigue strength of the blade component, particularly when subjected to foreign object damage which primarily occurs at the leading and trailing edges 54, 56. During engine operation the blade 14 is subjected to a significant tensile load due to centrifugal loads generated by rotation and also experiences vibration stresses as a result of aerodynamic and mechanical excitation.

Now referring to FIG. 4 the ultrasonic hammer peening equipment 38 comprises an ultrasonic hammer head piece 60 mounted on the end of a robotic arm such that the head 60 may transverse over the surface of the blade 14. The head 60 comprises a magnetostrictive transducer 41 connected to a waveguide system 62 and provided with a concentrator head having one or more hammer pins extending therefrom, shown singly in FIG. 2. The ultrasound propels the hammer 40 onto the surface to be treated 58. In an embodiment of the invention the fan blade 14 is subjected to simultaneous or near simultaneous application of ultrasonic hammer peeing to give similar local distortion or effect on either side of the component in order to prevent significant global distortion of the component or material. The use of multiple light alternating passes of the ultrasonic hammer peening system in order to reduce the global distortion at each stage of the procedure provides less detrimental stress in other areas of the fan blade 14.

Global rather than local distortion of the fan blade 14 may be used as a deliberate part of the production process thus allowing looser tolerances in earlier parts of the production process or as a correction method for previous production errors.

In this embodiment of the invention both sides of the fan blade 14 (as shown in FIG. 4) are treated. The leading and trailing edges 54, 56 are treated by pressing the pins 40 against the treated surfaces. The multiple pins 40 are rotated and translated to cover the leading and trailing edges 54, 56. In this embodiment six pins are employed being 5 mm in diameter and approximately 30 mm long although the sizes and number may vary according to requirements. The ultrasonic generator and transducer system 38 vibrates at frequencies greater that 20 kHz and operates at power levels up to approximately 5 kW. This application of ultrasonic hammer peening provides a deep compressive stress region in the leading and trailing edges of the fan blade 14 and improves its resistance to fatigue failure.

It has been shown through testing that the technique of ultrasonic hammer peening can achieve penetrations of at least 1.25 mm and an associated induced compressive stress of over 700 Mpa. This application of ultrasonic hammer peening provides deep compressive residual stresses in a strip along the leading and trailing edges extending across the fan blade 14 for up to approximately 20% of the chord width on both the pressure and suction sides of the blade 14. In order to avoid distortion it is advantageous to treat both sides simultaneously, however this is not necessary.

The hammer peening technique of the present invention may also be employed in the platform fillet region of an aerofoil blade or other areas of the blade which would benefit from benefit from compressive residual stress fields, for example in the root area where cracks may appear during service of the engine.

The method of the present invention is also particularly suitable for treating aerofoil blades which have been repaired to control the residual stress field present in the material. It is envisaged that an articulated robot system would be employed allowing the peening equipment to follow the profile of the blade and specifically tailor the levels of generated stress to either eliminate or control bending. However one sided treatment or unbalanced stress field generation might be employed to control the resulting distortion of a component for achieving a required shape in addition to tailoring the stress distribution.

Although the present invention has been described with reference to the ultrasonic peening of gas turbine engine fan blades, it will be appreciated that it is also applicable to other gas turbine engine components including aerofoil vanes that are subject to foreign object damage and fatigue cracking.

We claim:

1. A gas turbine engine component comprising one or more surfaces wherein at least one of said surfaces comprises an ultrasonic hammer peened surface and wherein a region of deep compressive residual stress caused by ultrasonic hammer peening is provided in said treated surface.

2. A gas turbine engine component as claimed in claim 1 wherein said component is a gas turbine engine aerofoil blade or vane comprising a leading edge and a trailing edge.

3. A gas turbine engine component as claimed in claim 2 wherein said leading and trailing edges comprise said hammer peened surface wherein a region of deep compressive residual stress caused by ultrasonic hammer peening is provided in at least one of said leading and trailing edges.

4. A gas turbine engine component as claimed in claim 3 wherein said aerofoil blade or vane comprises a fan blade.

5. A gas turbine engine component as claimed in claim 3 wherein said region of deep compressive residual stress extends up to 20% of the chord width on both the pressure side and suction side of the blade or vane.

6. A method of ultrasonic hammer peening a gas turbine engine component comprising the step of ultrasonic hammer peening at least one surface of said component so as to provide a region of deep residual compressive stress.

7. A method of ultrasonic hammer peening a gas turbine aerofoil blade or vane comprising the step of ultrasonic hammer peening at least one of the leading and trailing edges of said blade or vane on at least one of the suction and pressure sides thereof.

8. A method of ultrasonic hammer peening a gas turbine aerofoil blade or vane wherein both the pressure side and suction side of the blade is ultrasonic hammer peened simultaneously.

9. A method of ultrasonic hammer peening according to claim 6 wherein said ultrasonic hammer peening apparatus vibrates at a frequency greater than 20 kHz.

10. A method of ultrasonic hammer peening as claimed in claim 6 wherein the ultrasonic hammer peening apparatus operates at a power of up to 5 kW.

* * * * *